US010443002B2

(12) United States Patent
Sarkar et al.

(10) Patent No.: US 10,443,002 B2
(45) Date of Patent: Oct. 15, 2019

(54) PROCESS FOR QUALITY ENHANCEMENT IN HYDROCARBON STREAM

(71) Applicant: INDIAN OIL CORPORATION LIMITED, Mumbai, Maharashtra (IN)

(72) Inventors: Mainak Sarkar, Faridabad (IN); Arangarasu Arun, Faridabad (IN); Yamini Gupta, Faridabad (IN); Ganesh Vitthalrao Butley, Faridabad (IN); Madhusudan Sau, Faridabad (IN); Brijesh Kumar, Faridabad (IN); Santanam Rajagopal, Faridabad (IN); Arumugam Sakunthalai Ramadhas, Faridabad (IN); Ravinder Kumar Malhotra, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 14/416,602

(22) PCT Filed: Aug. 30, 2013

(86) PCT No.: PCT/IB2013/058152
§ 371 (c)(1),
(2) Date: Jan. 22, 2015

(87) PCT Pub. No.: WO2014/033676
PCT Pub. Date: Mar. 6, 2014

(65) Prior Publication Data

US 2015/0259613 A1 Sep. 17, 2015

(30) Foreign Application Priority Data

Aug. 31, 2012 (IN) ..... 2546/MUM/2012

(51) Int. Cl.

| | |
|---|---|
| ***C10G 67/12*** | (2006.01) |
| ***C10G 27/10*** | (2006.01) |
| ***C10G 27/14*** | (2006.01) |
| ***C10L 1/02*** | (2006.01) |
| ***C10L 1/18*** | (2006.01) |
| ***C10L 10/08*** | (2006.01) |
| ***C10L 10/12*** | (2006.01) |
| ***C10G 45/02*** | (2006.01) |
| ***C10G 27/04*** | (2006.01) |
| ***C10G 27/12*** | (2006.01) |

(52) U.S. Cl.

CPC ..... *C10G 67/12* (2013.01); *C10G 27/04* (2013.01); *C10G 27/10* (2013.01); *C10G 27/12* (2013.01); *C10G 27/14* (2013.01); *C10G 45/02* (2013.01); *C10L 1/026* (2013.01); *C10L 1/1805* (2013.01); *C10L 10/08* (2013.01); *C10L 10/12* (2013.01); *C10G 2300/202* (2013.01); *C10G 2300/307* (2013.01); *C10L 2200/0446* (2013.01); *C10L 2270/026* (2013.01); *C10L 2290/10* (2013.01); *C10L 2290/145* (2013.01)

(58) Field of Classification Search

CPC ..... C10G 27/04; C10G 27/10; C10G 27/12; C10G 27/14; C10G 45/02; C10G 67/12; C10G 2300/202; C10G 2300/307; C10L 1/026; C10L 1/1805; C10L 10/08; C10L 10/12; C10L 2200/0446; C10L 2270/026; C10L 2290/10; C10L 2290/145

See application file for complete search history.

(56) References Cited

U.S. PATENT DOCUMENTS

| | | | | | |
|---|---|---|---|---|---|
| 3,230,180 | A * | 1/1966 | Larson | B01J 31/1616 | 208/207 |
| 4,494,961 | A | 1/1985 | Venkat et al. | | |
| 4,705,620 | A * | 11/1987 | Bricker | C10G 19/08 | 205/444 |
| 4,723,963 | A | 2/1988 | Taylor | | |
| 4,897,180 | A * | 1/1990 | Bricker | B01J 31/0268 | 208/189 |
| 4,978,799 | A * | 12/1990 | Sanderson | C07C 29/48 | 568/385 |
| 5,169,516 | A * | 12/1992 | Carr | C10G 53/14 | 208/189 |
| 5,480,986 | A * | 1/1996 | Lyons | B01J 31/1815 | 540/145 |
| 5,767,320 | A * | 6/1998 | Raja | C07C 45/33 | 568/342 |
| 6,755,964 | B1 | 6/2004 | Agrawal et al. | | |
| 7,300,568 | B2 | 11/2007 | Ketley et al. | | |
| 7,501,054 | B2 * | 3/2009 | Galiasso | C10G 45/44 | 208/142 |

(Continued)

FOREIGN PATENT DOCUMENTS

| | | |
|---|---|---|
| EP | 0 252 606 A2 | 1/1988 |
| EP | 0 293 069 A1 | 11/1988 |

(Continued)

*Primary Examiner* — Prem C Singh
*Assistant Examiner* — Brandi M Doyle
(74) *Attorney, Agent, or Firm* — Maschoff Brennan

(57) ABSTRACT

The present invention discloses a process for enhancing quality of a hydrocarbon stream. More particularly, the present invention discloses a process for improvement of the combustion quality of a diesel range stream by dissolving an oxygen source in the feed stream before carrying out the oxidation, thereby enhancing the Cetane number, lubricity and reducing emission of the stream. The present invention also discloses a process for enhancing combustion quality of a hydrocarbon stream by carrying out the process in presence of an organometallic catalyst.

18 Claims, No Drawings

(56) References Cited

U.S. PATENT DOCUMENTS

| | | | | |
|---|---|---|---|---|
| 2001/0045054 | A1* | 11/2001 | Naegeli | C10G 27/04 44/603 |
| 2005/0109671 | A1* | 5/2005 | Ketley | C10G 27/04 208/3 |
| 2006/0021913 | A1 | 2/2006 | Ketley et al. | |
| 2006/0211906 | A1* | 9/2006 | Berezutskiy | C02F 1/28 585/820 |
| 2010/0025301 | A1 | 2/2010 | Borgna et al. | |
| 2011/0065969 | A1 | 3/2011 | Chan et al. | |

FOREIGN PATENT DOCUMENTS

| | | | |
|---|---|---|---|
| WO | 01/64817 | A2 | 9/2001 |
| WO | 2012/027820 | A1 | 3/2012 |

* cited by examiner

PROCESS FOR QUALITY ENHANCEMENT IN HYDROCARBON STREAM

FIELD OF THE INVENTION

The present invention relates to a process for enhancing quality of a hydrocarbon stream. More particularly, the present invention provides a process for improvement of the combustion quality of a diesel range stream of any quality or from any source, and mixtures thereof by enhancing the Cetane number, lubricity and reducing emission.

BACKGROUND OF THE INVENTION

Refiners are in need to modernize and optimize process such that the technology is equipped well enough to handle heavier crude baskets as the lighter crudes are getting depleted. This implies that the middle distillates fractionated are having reduced level of aliphatic hydrocarbons and higher level of aromatic hydrocarbons which indeed demands the need of Cetane improvement. The emission norms are becoming more stringent and to meet these standards, there is a need to improvise the cetane enhancement technology for betterment of diesel fuel quality. Cetane number (CN) has direct relation with the fuel quality and has vital impact on exhaust emissions. Cetane number is actually a measure of ignition quality of diesel fuel, i.e., fuel's ignition delay after injection and before combustion. Increasing Cetane number improves the ignition characteristics of fuel such as shorter ignition delays, easy cold weather starting, suppressing noise (engine knocking) during combustion, misfiring and improves engine efficiency. Higher Cetane also lowers the emissions, particularly NOx.

The cetane enhancement of the diesel range streams can be done broadly in two ways (1) by hydrogenation route and (2) by non hydrogenation route. The $1^{st}$ route is much more obvious, established and being practiced extensively in the refinery. Still this route has got certain disadvantages, (a) it involves costly hydrogen (b) it is a very high pressure and high temperature process and hence cost intensive (c) hydrogen consumption of some streams like LCO are very high but still the cetane gain is very nominal. The $2^{nd}$ route i.e. non-hydrogenation route can be classified in three categories viz. Cetane enhancement by (i) adding Additives, (ii) Nitration and (iii) adding Oxygen to the fuel. Additives like alkyl nitrate, di-tert-butyl peroxide, dimethyl ether and the like are used to enhance the CN but each additive has its own limitation either in way of quantity or cost. The nitration route gives very high CN boost, improves pour point, cloud point, and viscosity but it has very bad impact on stability. It increases sediment formation, haziness and results in deposits on storage. The third route is the addition of oxygen to the fuel.

The incorporation of oxygen in the diesel fuel improves its emission quality particularly NOx and particulate matter, and at the same time some oxygenate compounds also improves the burning quality i.e. cetane number of the fuel. For cetane improvement the oxidation reaction should be selective in nature otherwise the cetane may get deteriorated.

Various inventive works has been carried out in the past at improving cetane number of diesel range fuels. U.S. Pat. No. 4,494,961 provides method for increasing the Cetane number of a low hydrogen content, highly aromatic distillate through partial catalytic oxidation. Catalyst may be transition metal oxides alone or along with alkali/alkaline earth metal. European Pat. No. 0,252,606 discloses the Cetane improvement of middle distillate by catalytic oxidation at benzylic carbon atom using oxygen or oxidant at temperature below 200° C. with non-oxide metal compound catalyst. Also U.S. Pat. No. 4,723,963 discloses the additional information that diesel having at least 10 wt % alkyl aromatics or hydroaromatics can be selectively oxidized, preferably in to ketones.

European Pat. No. 0,293,069 discloses an additive tetralinhydroperoxide and use of the same as cetane improver such that peroxide number of diesel blend is 100-1000. It acts as cetane improver additive for diesel engine fuels and fuel production process by partial oxidation of hydrogenated diesel fraction originally having high aromatics (tetralin content>0.5 wt %) till the product reaches the peroxide number level of 100-150.

The method of manufacturing oxygenated fuel by contacting the feedstock with oxygen containing gas at oxidation conditions in presence of Group VIII metal catalyst on basic support is disclosed in U.S. Pat. No. 7,300,568. U.S. Pat. No. 7,501,054 discloses the process of upgrading diesel fuel by hydrogenating a portion of feedstock to enrich alkyl-naphthene-aromatic compounds followed by selective catalytic oxidation to alkyl ketones.

PCT application WO 2012/027820 discloses a method of cetane improvement by contacting diesel with ozone gas in presence of an alcohol and non-alcohol polar solvent (both solvents<10 vol %) to produce ozonated diesel oil along with oxidized byproducts which are removed later. Ultrasonic mixing of liquid hydrocarbon with oxidation source, catalyst and acids yields a diesel of substantially increased Cetane number. The cavitation created by ultrasonic mixing results in formation and collapse of micro-sized bubbles which highly increases the reactivity of reactants, is embodied in US Application. No. 2011/0065969.

In light of the above there still exists a need for an improved process for enhancing the quality of diesel fuels such as by enhancing cetane number.

OBJECTS AND SUMMARY OF THE INVENTION

It is an object of the present invention to provide a process for enhancing/increasing combustion quality of a hydrocarbon stream.

It is a specific object of the present invention to provide processes for enhancing/increasing cetane number of a diesel range stream.

It is also an object of the present invention to provide a process for enhancing/increasing cetane number of a diesel range stream, wherein the diesel range stream is saturated with an oxygen source, and at least a portion of the oxygen source is dissolved in the diesel range stream.

In one aspect, the invention provides a process for increasing cetane number of a diesel range stream, wherein the process comprises:

(a) providing a feed diesel range stream, with a sulfur content of less than 350 ppmw and a cetane number,
(b) saturating said diesel range stream with an oxygen source, and
(c) subjecting said oxygen source saturated diesel range stream to oxidation at a pressure of about 1 to 50 barg, to obtain oxidized diesel range stream with increased cetane number relative to the feed diesel range stream, wherein the saturated diesel range stream contains the saturating amount of oxygen source in dissolved form during oxidation.

In another aspect, the invention provides a process for increasing cetane number of a diesel range stream, wherein the process comprises:

(a) providing a feed diesel range stream with a sulfur content of less than 350 ppmw, and a cetane number, and (b) subjecting said diesel range stream to oxidation in the presence of an organometallic catalyst and an oxidizing agent, to obtain oxidized diesel range stream with increased cetane number relative to the feed diesel range stream, wherein said organometallic catalyst comprises salts of metal phthalocyanines.

In yet another aspect, the invention provides a process for increasing cetane number and lubricity of a diesel range stream, wherein the process comprises:

(a) providing a feed diesel range stream with a sulfur content of less than 350 ppmw, and a cetane number, (b) saturating said diesel range stream with an oxygen source, and (c) subjecting said oxygen saturated diesel range stream to oxidation in the presence of an organometallic catalyst, to obtain oxidized diesel range stream with increased cetane number relative to the feed diesel range stream, wherein said organometallic catalyst comprises salts of metal phthalocyanines.

DETAILED DESCRIPTION OF THE INVENTION

The present invention provides a process for improving the combustion quality of the diesel range streams and more particularly the cetane number, and a process for the same. Also, the other qualities viz. lubricity, emission quality and NOx emission are also improved as a part of the process.

According to the present invention, the Cetane number of any diesel range stream such as straight run kerosenes, straight run diesels, Light Cycle Oil (LCO), Coker gas oil (CGO), DHDS/DHDT product or mixtures thereof can be improved by addition and distribution of oxygen over the entire boiling range.

The term "diesel range stream" refers to any diesel range stream such as straight run kerosenes, straight run diesels, Light Cycle Oil (LCO), Coker gas oil (CGO), DHDS/DHDT product or mixtures thereof.

The term "feed diesel range stream" refers to any diesel range stream such as straight run kerosenes, straight run diesels, Light Cycle Oil (LCO), Coker gas oil (CGO), DHDS/DHDT product or mixtures thereof, which is subjected to any of the processes of the present invention for the purposes of improving its combustion quality, especially its cetane number.

The term "oxidized diesel range stream" refers to any diesel range stream such as straight run kerosenes, straight run diesels, Light Cycle Oil (LCO), Coker gas oil (CGO), DHDS/DHDT product or mixtures thereof, which has been subjected to any of the processes of the present invention for the purposes of improving its combustion quality, especially its cetane number.

The term "Saturating amount" of an oxygen source refers to the maximum amount of the oxygen source which can be dissolved in a diesel range stream.

According to the present invention, the diesel range stream containing hetero-atoms like sulfur, nitrogen and metals are preliminarily hydrotreated at optimum hydrotreating operating conditions in presence of a catalyst known in the art to remove the impurities below the acceptable limits. Further, the hydrotreated diesel range streams low in sulphur is oxidized with an oxidizing agent or agents in presence or absence of a catalyst.

In one embodiment, the process of enhancing cetane number according to the present invention is carried out in two stages, wherein the first stage is hydrotreatment of the diesel range streams at optimized condition by using any of the catalyst known in the art in order to eliminate the contaminants like sulfur, nitrogen and metals followed by second stage wherein the product is oxidised in presence or absence of a catalyst.

In another embodiment according to the present invention, if the diesel range stream is already low in sulphur such as DHDS (diesel hydrodesulfurization) or DHDT (diesel hydrotreating) product stream, then no further hydrotreatment is required. In an embodiment of the present invention, the acceptable limit of sulphur in the feed diesel range stream for the oxidation step is preferably <350 ppmw. More preferably, the sulphur content is less than 50 ppmw. In a most preferred embodiment, the sulphur content is less than 10 ppmw. The feed for DHDS unit primarily consists of straight run kerosene and diesel streams and rarely contains any cracked stream like LCO or coker gas oil; hence the concentration of di-aromatics is very limited. Majority of the time the concentration of di-aromatics in DHDS feed is less than 20 wt % and the concentration of mono-aromatics in the product is less than 10%. Hence, improvement of cetane number of DHDS product by oxidation route is very difficult. The feed streams for DHDT unit is primarily straight run kerosene and diesel stream, straight run like heavy diesel stream, along with cracked streams like heavy coker naphtha, coker kerosene, LCO and Coker gasoil. The ratio of straight run to cracked stream in DHDT product may vary from 4-1.5. So it contains appreciable amount of di-aromatic components. In contrary to DHDS, DHDT unit is very high pressure unit (80-105 bars) and catalyst is Ni-based, hence, majority of di-aromatic components get converted to naphthenes and the concentration of non-aromatic is also low (<20 wt %). So the improvement of cetane in DHDT product by selective oxidation is even more difficult than DHDS product.

Further in the second step of the present invention, the oxygen is introduced in the diesel range stream and distributed over the entire distillation range. The oxidation can be carried out in any type of reactor, such as, but not limited to, plug flow (PFR) or continuous stirred tank reactor (CSTR). The feed i.e. the diesel range stream with the acceptable limit of contaminant is brought in contact with an oxygen source (oxidizing agent) at a temperature between 35 to 200° C. in the presence or absence of a catalyst. The oxidation reaction is carried out for a period of 1 to 48 hours.

In an embodiment, the oxidizing agent or the oxygen source can be of any type, viz. organic, inorganic, molecular oxygen or ozone that can supply oxygen at the reaction conditions. More preferable is compressed air because of its low cost and abundance.

In another embodiment, the oxidizing agent for the reaction can be of any type, organic, inorganic, molecular oxygen or ozone or combinations thereof, which supplies oxygen at the reaction conditions. If the oxidizing agent is in the gaseous form, say compressed air, the reactor should be maintained under pressure of 2 to 50 barg. More preferably the pressure is between 5 and 25 barg. Even more preferably the pressure is between 10 and 20 barg to keep sufficient amount of oxidant in dissolved form. Pressure is required to keep gaseous oxygen in dissolved state so that during the course of reaction only single fluid phase exists in the reactor. At least a portion of the oxygen source is in dissolved form in the feed diesel range stream, throughout the oxidation step.

According to another embodiment of the present invention, the feed diesel range stream is saturated with the oxygen source under pressure of 2 to 50 barg. The oxygen source may be present in over saturating amounts, so that a sufficient amount of oxygen is available in dissolved form even when the oxygen source is being consumed during the oxidation step. In a preferred embodiment, the diesel range stream is saturated with the oxygen source throughout the oxidation step. In a more preferred embodiment, a saturated amount of oxygen source is in dissolved form throughout the oxidation step.

In the present invention, as the oxygen source is provided in dissolved form, the reaction proceeds in a single fluid phase. This provides advantage of processing larger volumes of feed in the reactors, as extra volume for the oxygen source in gaseous form is not required. This improves the output and efficiency of the reactor. The process of the present invention also provides advantage of conducting the reaction is small reactors. As the oxygen source is dissolved in the feed, small reaction volumes are required and the reaction can be carried out in small reactors.

Further in an embodiment, the oxidizing agents either solid or liquid can be directly added to the feed or can be added step wise using suitable arrangement like dosing pump or by any pneumatic arrangement. For the gaseous oxidizing agent mass flow controller can be used.

According to the invention, supplying the gaseous reactant (oxidizing agent) in dissolved form is further preferable owing to the reasons that, there is better catalyst wetting, ease of reactor design, ease of fluid distribution across the reactor diameter and easy operability, i.e. absence of vibrations, lower pressure drops, etc.

In another embodiment of the present invention, the oxidation step is carried out in the presence of a catalyst such as an organometallic complex of any transition metal and more preferably of Fe, Cr, Cu and Co or mixtures thereof. In a process of improving combustion quality of a diesel range stream, when the oxidation step is carried out in the presence of an organometallic complex of any transition metal, it accelerates the rate of reaction and helps to improve the selectivity for the reaction. The feed and the oxidizing agents can be contacted with the catalyst either in fixed bed, fluidized bed or CSTR. The reaction time in presence of catalyst is preferably between 0.5 to 20 hours. More preferably the reaction time in presence of catalyst is between 1 and 7 hrs. If the catalyst is in the powdered form suitable arrangements should be taken to separate the catalyst particle from the product streams. The reaction time without catalyst is between 20 and 48 hrs. More preferably the reaction time without catalyst is within 20 to 35 hrs.

In an embodiment, organometallic catalyst can be prepared by impregnating suitable derivatives of metal phthalocyanines or amino salts on inert support material with suitable binders. The support material can be selected from activated charcoal, silica or silica/alumina or alumina or other known materials in the art. The derivatives of organometallic complexes can be selected from but not limited to nitride, nitrate, chloride, sulfide, sulfate, sulfonate, amides or mixtures thereof. The impregnation can be done by dissolving or distributing the derivatives of metal phthalocyanines or amino salts in suitable solvent such as liquid anhydrous ammonia, alcohols or water and using this solution for impregnation by incipient wetting, pore diffusion techniques or other known procedures in the art and followed by subsequent drying. The metals can be selected from but not limited to Fe, V, Co, Ni or mixtures thereof. The organometallic complex compounds is impregnated on inert supports of silica, silica/alumina, activated carbon or any other suitable support by the procedures known in the art in such a way that total compound constitutes 0.1 to 10 wt % of total catalyst. It has been found that organometalic catalysts have better selectivity for oxidizing the molecules which enhances cetane onoxidation even at lower concentration. Therefore, it has been found that it is suitable for cetane number enhancement of even DHDS and/or DHDT products.

In another embodiment according to the invention, organometallic catalyst can be used in combination with an oxide based catalyst. The oxide based catalyst can be prepared by incipient wetting of extrudates of inert support material with suitable binders by aqueous solutions of metal salt compounds with subsequent drying. The support material can be selected from activated charcoal, silica or silica/alumina or alumina or other known materials in the art. The metal oxides are generally combinations of two or more oxides selected from Fe, Cr, Cu and Co. The total metal content of oxide catalyst is 1 to 30 wt %; the oxides of metals are of two or more different metals each constituting 1 to 25 wt % of total catalysts. The combination of organometallic catalyst and oxide based catalystcan be prepared in various combinations thereof. It is preferable to impregnate two or more metal oxides first and then dry the catalyst and then impregnate the organometallic complex followed by drying. The most preferred total metal content for this type of catalyst is 1 to 20 wt % for each metal in oxide form and 0.1 to 5 wt % in organometallic form. The organometallic complex catalysts and oxide catalysts when used in combination are in a specific ratio. In a specific combination, the preferred ratio of oxide catalyst to organometallic catalyst is in the range of 1:0.5 to 1:1 w/w.

In a preferred embodiment of the present invention, the organometallic catalyst is selected from organic complexes such as metal derivatives of quarternary onium salts, metal porphyrins, metal derivatives of phthalocyanines, or a mixture thereof.

In a further embodiment of the present invention, the process of improving the combustion quality of a diesel range stream comprises the steps of dissolving the oxygen source in the feed diesel range stream and carrying out the oxidation step in the presence of an organometallic complex alone, or in combination with an oxide based catalyst. The oxygen source or the oxidizing agent for the reaction can be of any type, organic, inorganic, molecular oxygen or ozone or combinations thereof, which supplies oxygen at the reaction conditions. If the oxidizing agent is in the gaseous form, say compressed air, the reactor should be maintained under pressure of 2 to 50 barg. More preferably the pressure is between 5 and 25 barg. Even more preferably the pressure is between 10 and 20 barg to keep sufficient amount of oxidant in dissolved form. Pressure is required to keep gaseous oxygen in dissolved state so that during the course of reaction only single fluid phase exists in the reactor.

The present invention also discloses that the partial recycle of the product improves yield and selectivity of the process. The recycle feed to fresh feed ratio is between 0.1 to 1 vol/vol.

The oxidized diesel range stream formed by the processes of the present invention have increased cetane number relative to the feed diesel range stream. The said oxidized diesel range stream has enhanced combustion qualities particularly the cetane number and the processes of the present invention do not alter the storage stability, color, density and the boiling range of the diesel range stream at any significant level. The product meets the norms of Euro-III, IV and V diesel fuel.

The following non-limiting examples illustrate in detail about the invention. However, they are, not intended to be limiting the scope of the present invention in any way.

Example 1

The hydrotreated Light Cycle Oil with cetane number 27.0 and the compressed air when passed over the bed of Cu/Cr oxide based catalyst at 100° C., 20 barg, 0.2 $h^{-1}$ LHSV and 200 $Nm^3/m^3$ Air/Oil ratio, the cetane number of the product gets improved by 3.2 units to cetane number 30.2 In this experiment no other oxidizing agents has been used except compressed air. No change has been observed in density and distillation of the product as compared to feed.

Example 2

The similar experiment as in Example 1 was carried out with same feed i.e., hydrotreated LCO with cetane number 27.0 at 120° C., 20 barg, 0.2 $h^{-1}$ LHSV and 200 $Nm^3/m^3$ Air/Oil ratio along with 1 wt % benzoyl peroxide. The Cetane number of the product gets improved by 4.7 units to cetane number 31.7. In this experiment, both air and benzoyl peroxide have been used as oxidizing agents. No change has been observed in density and distillation of the product as compared to feed.

Example 3

The hydrotreated LCO with cetane number 35.5 when passed over the Cu/Cr/Fe oxide based catalyst along with compressed air at 130° C., 20 bar g, 0.2 to 0.5 $h^{-1}$ LHSV and 200-300 $Nm^3/m^3$ Air/oil ratio, the cetane number of the resultant product increased by 2.0 units to 37.5. Only compressed air has been used as oxidizing agent. No significant change in density and distillation has been observed.

Example 4

The hydrotreated LCO with cetane number 32.6 when passed over the Co-based organometallic complex impregnated on activated charcoal catalyst along with compressed air at 80 and 100° C., 20 barg, 0.1 & 0.5 $h^{-1}$ LHSVs and 200-300 $Nm^3/m^3$ Air/oil ratio, the cetane number of the resultant product increased by 3.5 and 3.8 units to 36.1 and 36.4 respectively. Only compressed air has been used as oxidizing agent. No significant change in density and distillation has been observed.

Example 5

The similar study as in Example 4 was carried out with DHDS product stream at 100° C., 20-30 barg, 0.1 to 0.5 $h^{-1}$ LHSV and 200-300 $Nm^3/m^3$Air/Oil ratio. The product's Cetane number increased by 1.2 unit to 52.6 from 51.4 in feed. Besides air, no chemical oxidizing agents was used during the course of experiment. No appreciable change in density and distillation is observed.

Example 6 (Comparative Example)

DHDS product with cetane number 56.1 and the compressed air when passed over a bed of Cu/Cr oxide based catalyst at 120° C., 20 barg, 0.2 $h^{-1}$ LHSV and 200 $Nm^3/m^3$ Air/Oil ratio. The Cetane number of the resulted product gets decreased by 7.1 units to 49.0.

The example 5 in comparison to example 6 shows that organometallic catalyst provides a selective oxidation wherein the cetane number of even DHDS products is improved, as contrary to the use of metal based oxide catalysts. The cetane number of DHDS product deteriorates on oxidation in presence of Cu/Cr oxide based catalyst, as shown in example 6.

Example 7

The similar study as in Example 4 was carried out with DHDS product stream at 100° C., 20-30 bar g, 0.1 to 0.5 $h^{-1}$ LHSV and 200-300 $Nm^3/m^3$ Air/Oil ratio. The product's Cetane number increased by 1.7 unit to 53.1 from 51.4 in feed. Besides air, no chemical oxidizing agent was used during the course of experiment. No appreciable change in density and distillation is observed.

Example 8

DHDS product (CN: 52) saturated with air was passed over a bed of alumina impregnated with Co-based organometallic complex at 120° C., 20 barg, 0.2 $h^{-1}$ LHSV and 200 $Nm^3/m^3$ Air/Oil ratio. The Cetane number of the resulted product gets increased by 1.6 units to 53.6. The cetane number of DHDS product improves on oxidation in presence of Co-based organometallic complex catalyst.

Example 9

In one experiment LCO stream has been hydrogenated over a hydrotreating catalyst at WABT of 390° C. and 50 bar hydrogen partial pressure. The hydrotreated product (CN<30) is then subjected to oxidation at a temperature of 100° C. and 20 bar air pressure in presence of Co-based organometallic complex impregnated on activated charcoal. The cetane number of the oxidised product increased by 11 units.

Example 10

In another experiment DHDT feed stream has been hydrotreated over a commercial hydrotreating catalyst at WABT of 356° C. and 70 bar hydrogen partial pressure. The hydrotreated product (CN: 46.8) is then subjected to oxidation at a temperature of 100° C. and 20 bar air pressure in presence of Co-based organometallic complex impregnated on activated charcoal. The cetane number of the oxidised product increased by 2.5 units to 49.3.

It may be noted that the embodiments illustrated and discussed in this specification are intended only to teach to those skilled in the art the best way known to the Inventors to make and use the invention. In describing embodiments of the Invention, specific terminology is employed merely for the sake of clarity. However, the invention is not intended to be restricted to specific terminology so-used. The above-described embodiments of the invention may be modified or varied, without departing from the invention, as appreciated by those skilled in the art in light of the above teachings. It is therefore understood that, within the scope of the claims and their equivalents, the invention may be practiced otherwise than as specifically described.

We claim:

1. A process for increasing cetane number of a diesel range stream, the process comprising:

(a) providing a feed diesel range stream, with a sulfur content of less than 350 ppmw and a cetane number;

(b) saturating said diesel range stream with an oxygen source; and (c) subjecting said oxygen source saturated diesel range stream to selective oxidation in presence of an oxide based catalyst in combination with organometallic catalyst at a pressure of about 1 to 50 barg, to obtain oxidized diesel range stream with increased cetane number relative to the feed diesel range stream;

wherein the saturated diesel range stream contains oxygen source in dissolved form during oxidation;

wherein the oxygen source is selected from ozone, ozone containing gas or mixture thereof;

wherein the ozone is present in concentration of about 0.1 to 30 vol %;

wherein the oxide based catalyst is selected from oxides of Cr, Cu or a mixture thereof.

2. The process of claim 1, further comprising a step of hydrotreating the feed diesel range stream before step (a).

3. The process of claim 1, wherein the feed diesel range stream is selected from mineral petroleum oil, straight run kerosenes, straight run diesels, light cycle oil (LCO), coker gas oil (CGO), Diesel hydrodesulphurization (DHDS), Diesel hydrotreatment (DHDT) product or mixtures thereof.

4. The process of claim 1, wherein the oxidation step is carried out at a temperature of about 35° C. to 200° C. and for a period of about 1 to about 48 hours.

5. The process of claim 1, further comprising partially recycling the oxidation product during oxidation step, wherein the recycle feed to fresh feed ratio is between 0.1 to 1.0 vol/vol.

6. The process of claim 1, wherein the increase in cetane number in the oxidized diesel range stream is 1 to 15 units relative to the feed diesel range stream.

7. A process for increasing cetane number and lubricity of a diesel range stream, the process consisting of the step of:

(a) providing a hydrotreated feed diesel range stream with a sulfur content of less than 350 ppmw, and a cetane number;

(b) saturating said diesel range stream with an oxygen source; and (c) subjecting said oxygen saturated diesel range stream to selective oxidation in the presence of an oxide based catalyst in combination with organometallic catalyst to obtain oxidation product; and (d) partially recycling the oxidation product by mixing with fresh feed diesel range stream, to obtain oxidized diesel range stream with increased cetane number relative to the feed diesel range stream;

wherein said organometallic catalyst comprises salts of metal phthalocyanines, wherein the metal in metal phthalocyanines is selected from V, Ni or a mixture thereof;

wherein the saturated diesel range stream contains oxygen source in dissolved form during oxidation;

wherein the oxygen source is selected from ozone, ozone containing gas or mixture thereof;

wherein the ozone is present in concentration of about 0.1 to 30 vol %;

wherein the oxide based catalyst is selected from oxides of Cr, Cu or a mixture thereof.

8. The process of claim 7, wherein the feed diesel range stream is selected from mineral petroleum oil, straight run kerosenes, straight run diesels, light cycle oil (LCO), coker gas oil (CGO), Diesel hydrodesulphurization (DHDS), Diesel hydrotreatment (DHDT) product or mixtures thereof.

9. The process of claim 7, wherein the oxidation step is carried out at a temperature of about 35° C. to 200° C. and for a period of about 0.5 to about 20 hours.

10. The process of claim 7, wherein the salts of metal phthalocyanines impregnated on inert support material.

11. The process of claim 10, wherein the salts of metal phthalocyanines are selected from nitride, nitrate, chloride, sulfide, sulfate, sulfonate, amide or mixtures thereof.

12. The process of claim 10, wherein the support material is selected from activated charcoal, silica, silica/alumina, alumina or a mixture thereof.

13. The process of claim 7, wherein the total metal content of oxide based catalyst is 1 to 30 wt %.

14. The process of claim 13, wherein the oxides of metals are of two or more different metals, each constituting 1 to 25 wt % of total catalysts.

15. The process of claim 7, wherein the combination of organometallic catalyst and oxide based catalyst has a total metal content of 1 to 20 wt % for each metal in oxide form and 0.1 to 5 wt % in organometallic form.

16. The process of claim 15, wherein the oxide based catalyst and the organometallic catalyst are in the ratio of 1:0.5 to 1:1 w/w.

17. The process of claim 7, wherein the recycle feed to fresh feed ratio is between 0.1 to 1.0 vol/vol.

18. The process of claim 7, wherein the increase in cetane number in the oxidized diesel range stream is 1 to 15 units relative to the feed diesel range stream.

* * * * *